US007108527B2

(12) United States Patent
Oldfield et al.

(10) Patent No.: US 7,108,527 B2
(45) Date of Patent: Sep. 19, 2006

(54) SEX CHANGEABLE ADAPTER FOR COAXIAL CONNECTORS

(75) Inventors: William W. Oldfield, Redwood City, CA (US); Kyle Stickle, San Jose, CA (US); Thomas H. Roberts, Morgan Hill, CA (US)

(73) Assignee: Anritsu Company, Morgan Hill, CA (US)

( * ) Notice: Subject to any disclaimer, the term of this patent is extended or adjusted under 35 U.S.C. 154(b) by 0 days.

(21) Appl. No.: 10/987,393

(22) Filed: Nov. 12, 2004

(65) Prior Publication Data

US 2005/0153601 A1 Jul. 14, 2005

Related U.S. Application Data

(60) Provisional application No. 60/519,332, filed on Nov. 12, 2003.

(51) Int. Cl.
*H01R 29/00* (2006.01)
*H01R 13/64* (2006.01)

(52) U.S. Cl. ..... 439/176; 439/246; 439/638

(58) Field of Classification Search ..... 439/176, 439/246, 248, 252, 638, 675
See application file for complete search history.

(56) References Cited

U.S. PATENT DOCUMENTS

| | | | | | |
|---|---|---|---|---|---|
| 4,789,351 | A * | 12/1988 | Fisher et al. | ..... | 439/248 |
| 4,846,731 | A * | 7/1989 | Alwine | ..... | 439/651 |
| 4,891,015 | A | 1/1990 | Oldfield | | |
| 4,967,173 | A * | 10/1990 | Watson | ..... | 333/260 |
| 2005/0153601 | A1 * | 7/2005 | Oldfield et al. | ..... | 439/638 |

* cited by examiner

*Primary Examiner*—James R. Harvey
(74) *Attorney, Agent, or Firm*—Fliesler Meyer LLP

(57) ABSTRACT

Systems in accordance with embodiments of the present invention can include an adapter having a sliding portion (a slider) slidable to expose an interface, thereby allowing mating—for example, between a test port and a DUT—to be observed and adjusted as required. The slider is removable, allowing an adapter sex change. In one embodiment, an insertion tool is provided which can hold a dual male pin and allow installation and removal of the dual male pin while assisting mating alignment. After calibration, the slider can be locked in place and the adapter can function as a standard coaxial connector.

13 Claims, 10 Drawing Sheets

Female Adapter

SEX CHANGEABLE ADAPTER FOR COAXIAL CONNECTORS

CLAIM OF PRIORITY

This application claims priority from U.S. Provisional Patent Application No. 60/519,332 entitled "Sex Changeable Adapter for Coaxial Connectors" by Oldfield et al., filed Nov. 12, 2003 incorporated herein by reference.

TECHNICAL FIELD

The present invention relates to coaxial connectors and adapters for connecting coaxial connectors.

BACKGROUND

A coaxial connector used as a test port of a test system (e.g., a vector network analyzer) requires calibration to impart accuracy to the test system. Calibrating test ports typically includes measuring precision coaxial standards having parameters incorporated into the test system. One of the requirements for calibrating test ports is a through measurement of a coaxial standard or alternatively, connection of two test ports. The test ports must either mate with each other or with opposite ends of the coaxial standard. If the test ports are mated without a coaxial standard, then one test port must be a male connector and the other test port must be a female connector. If the test ports are mated with a coaxial standard, the test ports must mate with opposite ends of the coaxial standard. Where the coaxial standard includes opposite ends that are male connectors, the test ports must each be female connectors.

Often, a device under test (DUT) does not have connectors of the same sex as the calibration standard (for instance, the DUT connectors are often female/female and will not mate with the test ports described above). Unfortunately, the use of additional intermediary adapters to change the sex of one or more of the test ports to accommodate the DUT can seriously degrade calibration. It can therefore be desirable to have the ability to change the sex of the test port without degrading calibration.

One method of changing the sex of a test port is described in U.S. Pat. No. 4,891,015 entitled "Universal Connector with Interchangeable Male and Female Sleeves for Use in Network Analyzers and Microwave Devices," issued to Oldfield. The design disclosed in Oldfield '015 can be non-optimal for very high frequency coaxial connectors, such as 1.85 mm and 1 mm connectors. These connectors are very small and pose particular problems. One problem is that calibration components used for the smaller connectors are often line-reflect-line (LRL) components. LRL components are coaxial through-lines that have no center conductor support. Where the length of the lines is long, as is required for lower frequency calibration, the second connection is difficult to consummate because the center conductor is often not centered and will not mate with the test port. Also, the interface between the test port and the LRL can be hidden from view during mating, due to overlapping connection parts of the coaxial connectors. Also problematic for LRL components is installation of a male pin for changing the sex of the connector from female to male. The small diameter of the male pin—the 1 mm connector pin is less than 0.010 inches in diameter—can make installation difficult and less convenient.

BRIEF DESCRIPTION OF THE FIGURES

Further details of embodiments of the present invention are explained with the help of the attached drawings in which.

DETAILED DESCRIPTION

A system in accordance with one embodiment of the present invention can include an adapter having a sliding portion (a slider) slidable to expose an interface, thereby allowing mating—for example, between a test port and a DUT—to be observed and adjusted as required. The slider is removable, allowing an adapter sex change. In one embodiment, an insertion tool is provided which can hold a dual male pin and allow installation and removal of the dual male pin while assisting mating alignment. After calibration, the slider can be locked in place and the adapter can function as a standard coaxial connector.

Figure 1A:
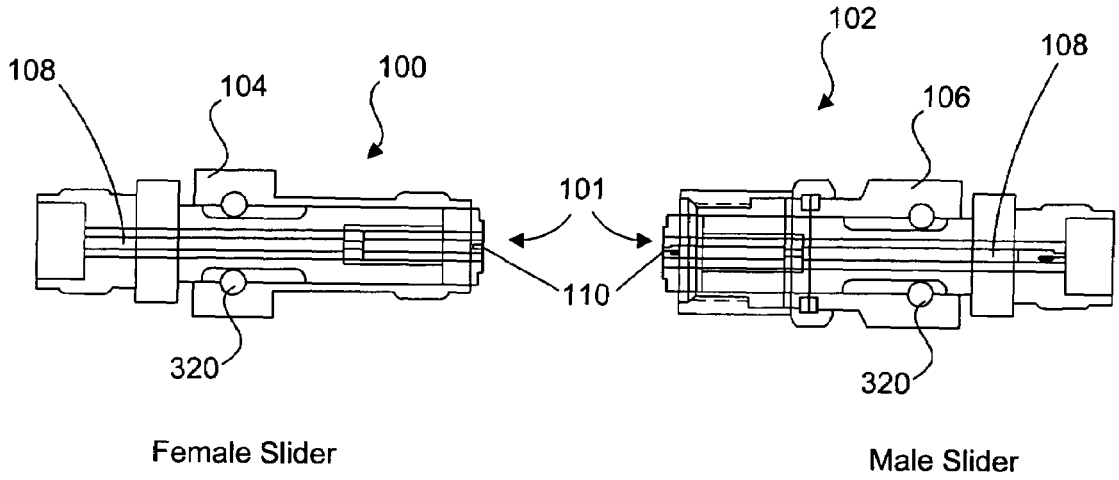
FIG. 1A is a side view of an adapter having a female slider in a retracted position and an adapter having a male slider in a retracted position in accordance with one embodiment of the present invention.
Figure 1B:
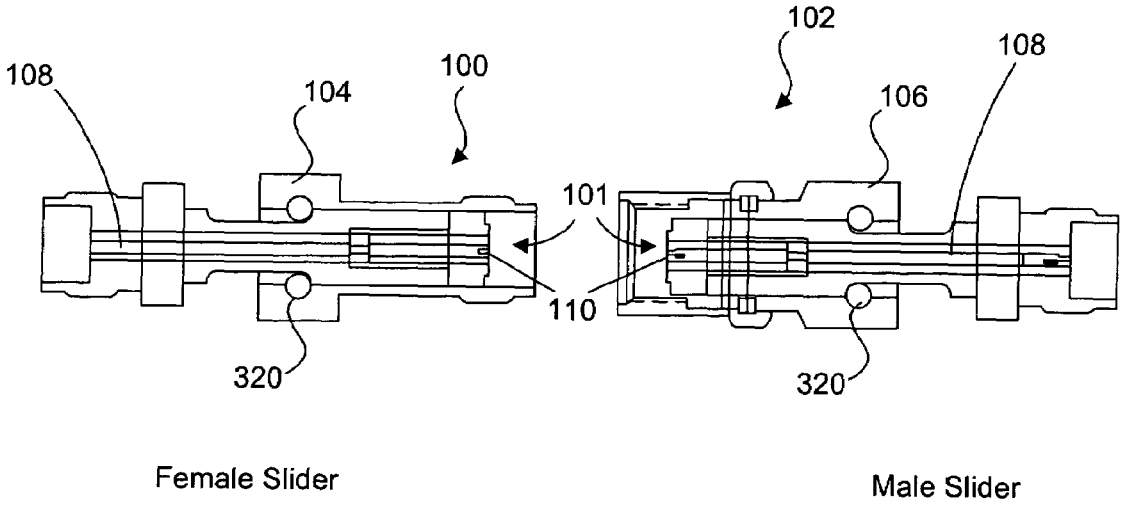
FIG. 1B is a side view of an adapter having a female slider in a forward position and an adapter having a male slider in a forward position in accordance with one embodiment of the present invention.

FIG. 1A illustrates a first adapter 100 having a female slider 104 and a second adapter 102 having a male slider 106. Both sliders 104,106 are shown in a retracted position, exposing an interface 101 for mating the adapters 100,102. FIG. 1B illustrates the sliders 104,106 in a forward position. In one embodiment, the male slider 106 can be shaped to overlap or otherwise complement the female slider 104, such that when the sliders 104,106 are moved to a forward position, the sliders 104,106 mate with each other and can be fixed in position to prevent relative movement. A center conductor 108 is associated with each of the adapters 100,102. The center conductor 108 includes a female contact 110, adaptable by inserting a male pin into the female contact 110 using the insertion tool (shown in FIG. 6).

Figure 2:
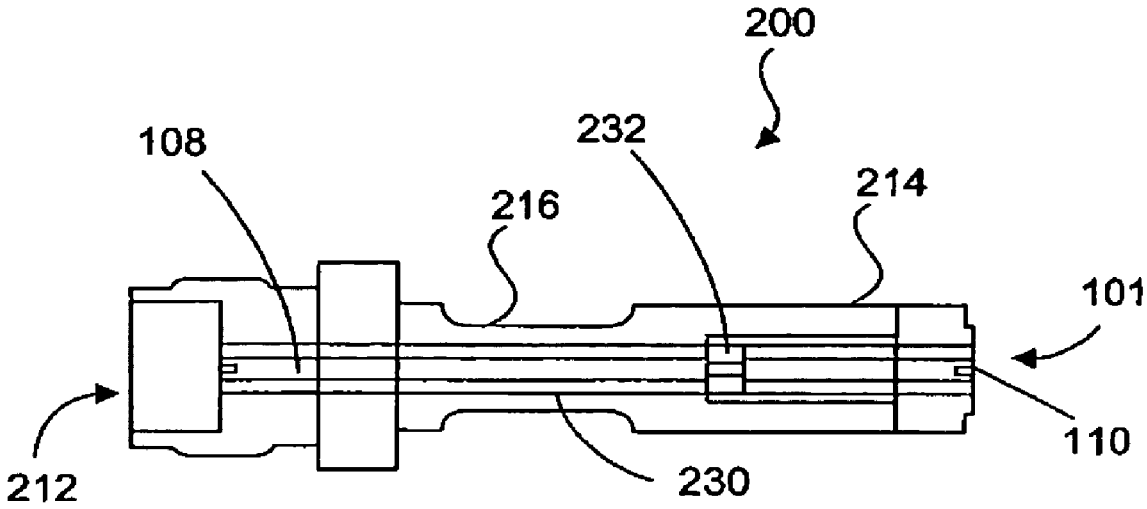
FIG. 2 is a side view of the adapter of FIGS. 1A and 1B without a slider.

An adapter 200 lacking a slider is shown in FIG. 2, and comprises the center conductor 108, a support bead 232 and an outer conductor 230. A proximal end of the adapter 200 can include a standard female connector 212. Alternatively, the proximal end of the adapter 200 can include a standard male connector for connecting to a female test port or other coaxial connector. Connected between the standard female connector 212 and the interface 101 is a cylinder 214 having a diameter approximately equal to a diameter of a standard male connector. A pair of flats 216 positioned approximately parallel to one another can be formed in the cylinder 214 and can include a length substantially equal to a desired sliding distance for a slider 104,106. At a right angle to the flats 216 and at a distal end of each of the flats 216 are two half round cuts (also referred to herein as cylinder grooves)(not shown).

Figure 3:
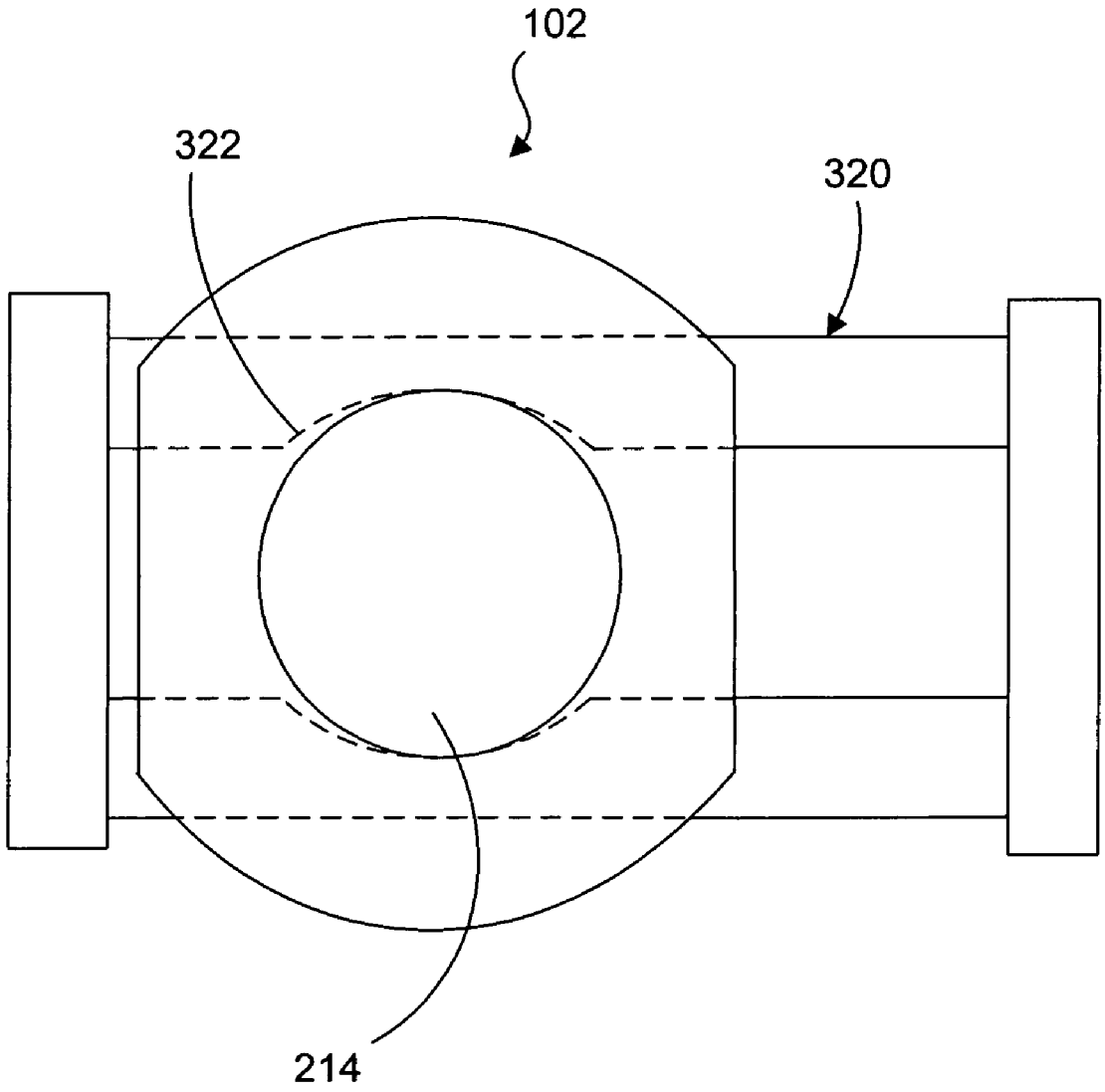
FIG. 3 is a frontal view of a slider having lock pins for limiting motion of the slider in accordance with one embodiment of the present invention.

As shown in FIG. 3, in one embodiment the slider 104,106 can include two lock pins 320 that can be fitted into pin holes 122 in the slider 104,106 and slid relative to the slider 104,106 along a plane approximately perpendicular to an axis of symmetry of the center conductor 108. Each lock pin 320 can include a semi-circular groove 322 or bend formed along a portion of the lock pin 320. The lock pins 320 can be spaced apart and oriented such that when the lock pins 320 are at a first position (i.e., an unlocked position), the semi-circular grooves 322 allow the slider 104,106 to slide along the entire diameter of the cylinder 214, and when the lock pins 320 are at a second position (i.e., a locked position), the lock pins 320 can limit the movement of the slider 104,106. In one embodiment, the lock pins 320 can be fixedly connectable at one or both ends of the lock pins 320, while in other embodiments, the lock pins 320 can be individually adjustable.

The slider 104,106 can be slid over the cylinder 214 and positioned so that lock pins 320 can be inserted into the pin holes 122, passing adjacent either the flats 216 or the two half round cuts (not shown) and capturing the slider 104, 106. With the lock pins 320 set to the locked position and parallel to the flats 216, the slider 104,106 cannot rotate, but can slide back and forth within the limit of the flats 216. If the lock pins 320 are positioned along the half round cuts 218 and set to the locked position, the slider 104,106 is captured in the standard connector position and cannot slide.

When used as connectors for an LRL calibration, the adapters 100,102 should have precise pin depth. Pin depth is the relationship between the outer conductor 230 mating surface and the end of the center conductor 108. LRL calibration lines have center conductors 108 without support beads 232. The location of the center conductor 108, therefore, can be determined by the pin depth of the test ports. If the pin depth is not precisely set, the calibration can be degraded.

Figure 4:
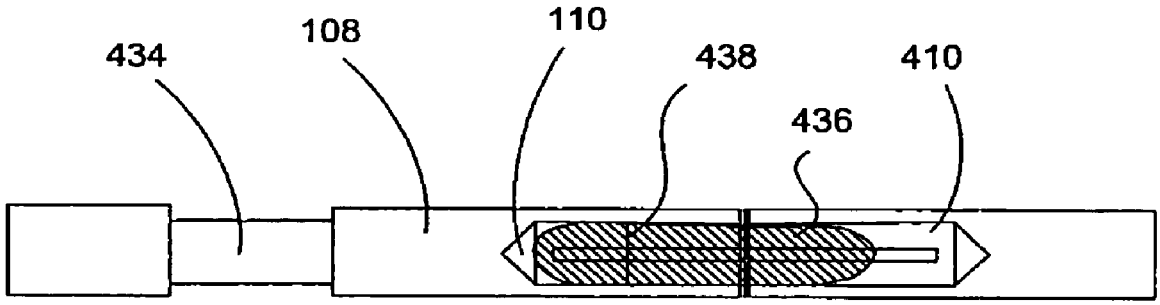
FIG. 4 is a side view of an center conductor of the adapter of FIG. 2.

Referring to FIG. 4, the adapter support bead 232 fits onto a necked portion 234 of the center conductor 108 having a smaller diameter than the remaining portion of the center conductor 108. Typically, the length of the necked portion 434 is approximately the same as the length of the support bead 232, mechanically setting the pin depth of the test port connector. However because of machining tolerances, the center conductor 108 must always be shorter than the outer conductor 230 because the center conductor 108 cannot extend beyond a mating surface of the outer conductor 230. If the center conductor 108 extends beyond the mating surface, the connector can be damaged when mated with another connector having perfect pin depth. To facilitate setting a perfect pin depth, the necked portion 434 of the center conductor 108 can be slightly longer than the length of the support bead 232, allowing the center conductor 108 to slide back and forth slightly. Epoxy, or some other adhesive, can be applied to the contact surfaces of the support bead 232 and the center conductor 108. The pin depth can then be set exactly to zero and the epoxy is allowed to dry.

As shown in FIG. 4, a system for changing the sex of an adapter 100,102 can include a dual male pin 436 connectable with the center conductor 108. The dual male pin 436 has two ends: a first end having a standard pin shape, and a second end having a slightly increased diameter with a sharp edge 538 where the diameter changes. The second end can be inserted into the female contact 110 of the center conductor 108 of a test port as shown. The female contact 110 can be tapered so that the dual male pin 436 contacts the female contact 110 at the entry to the cavity. The dual male pin 436 can be a length such that the dual male pin 436 fills the length of the female contact 110 and protrudes beyond the female contact 110 a distance such that the portion extending beyond the entry of the cavity is approximately the same length as that of a standard male pin. For example, the dual male pin 436 can be longer than twice the protrusion of a standard male pin. When another female contact 410 engages the first end of the dual male pin 436 and is subsequently withdrawn, the increased diameter of the second end of the dual male pin 436 provides withdrawal resistance so that the dual male pin 436 remains in the male adapter 102.

Figure 5:
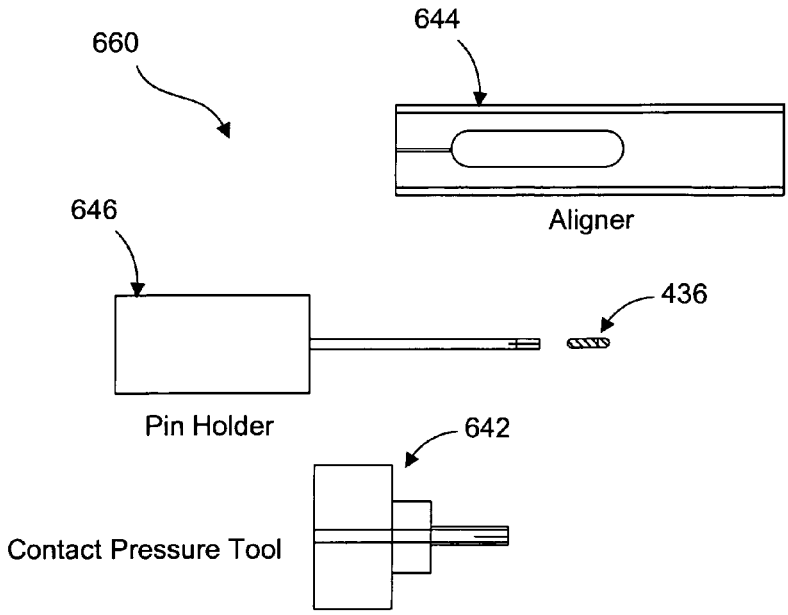
FIG. 5 is an exploded view of an insertion tool for inserting the dual male pin, in accordance with one embodiment of the present invention.
Figure 6:
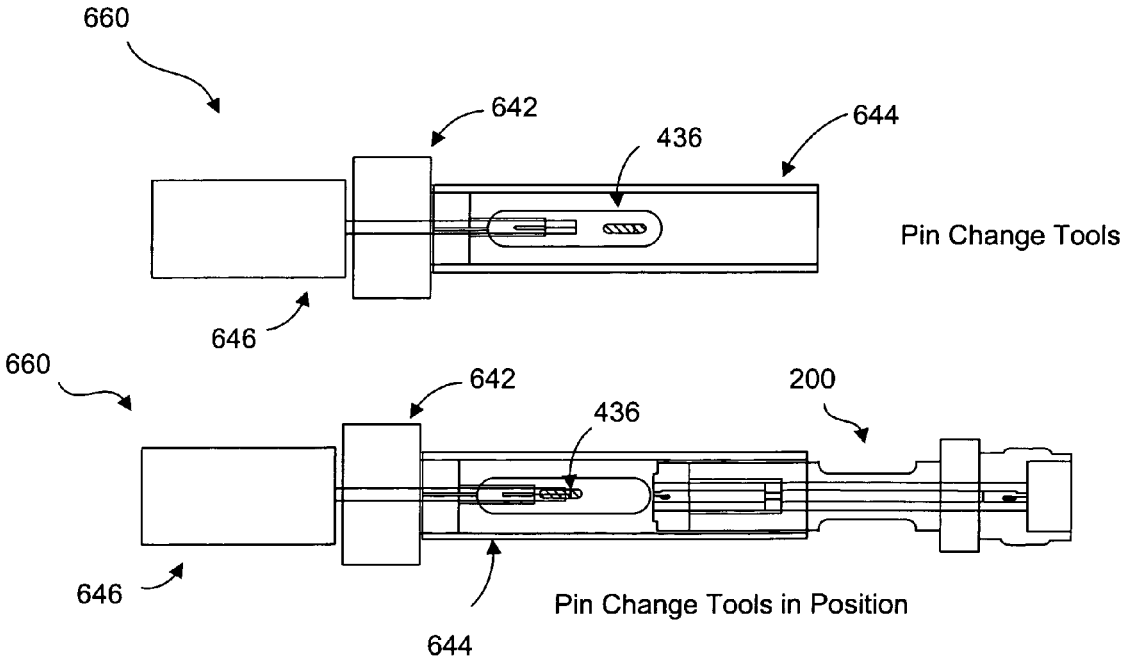
FIG. 6 is a side view of the insertion tool of FIG. 5 positioning the dual male pin in the adapter.

The diameter of the dual male pin 436 in a high frequency connector is approximately the size of a period in a sentence; therefore, it can be desirable to have an insertion tool for inserting and withdrawing the dual male pin 436 from the female contact 110. As shown in FIGS. 5 and 6, an insertion tool 660 in accordance with one embodiment of the present invention can comprise a pin holder 646, a contact pressure tool 642, and an aligner 644. The pin holder 646 and pressure tool 642 each can include female contacts. The female contact of the pin holder 646 is not crimped and holds the dual male pin 436 loosely and in the proper orientation.

Figure 7:
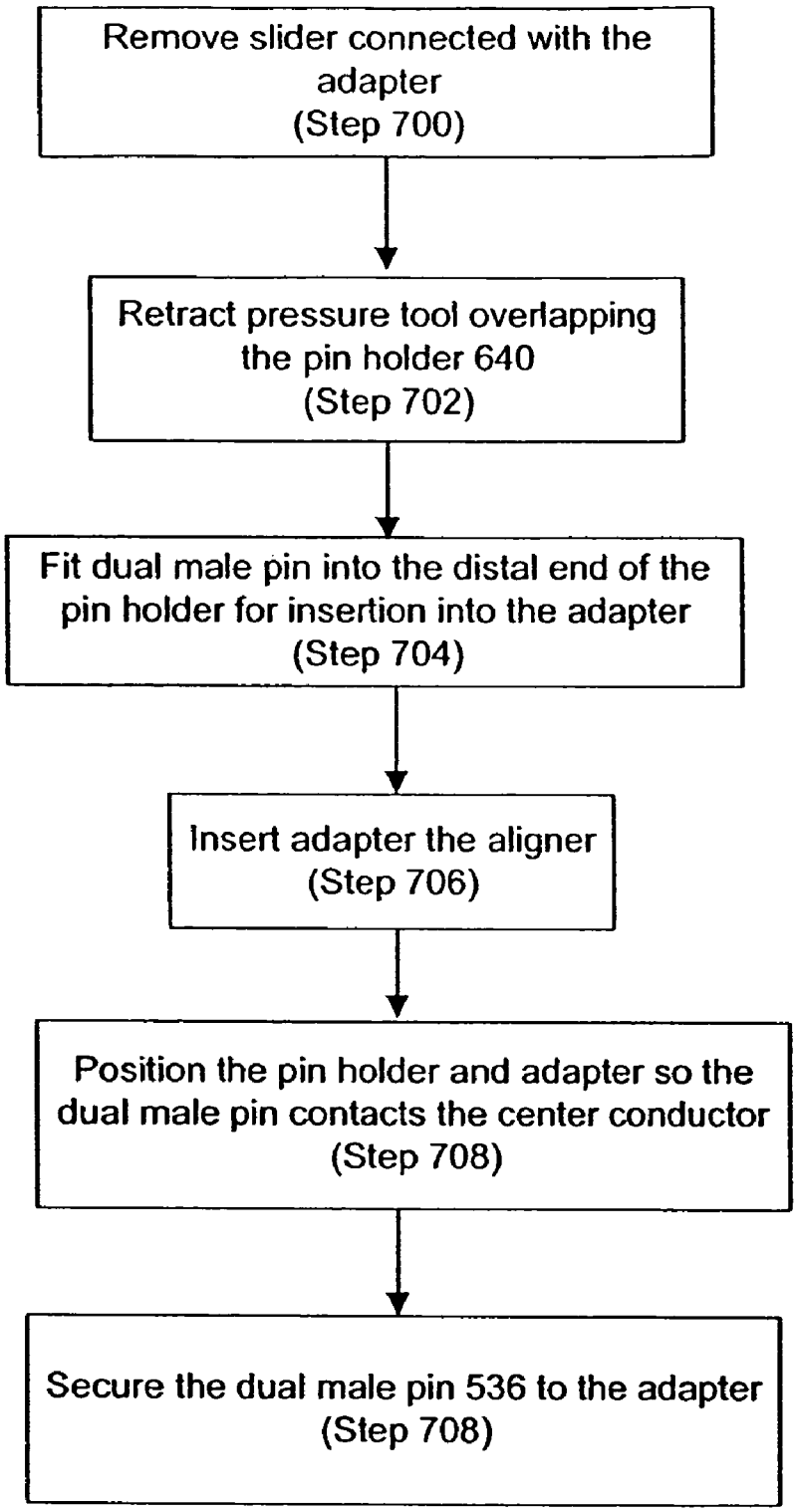
FIG. 7 is a flowchart illustrating a method to change the sex of a female adapter in accordance with one embodiment of the present invention.

A method to change the sex of an adapter for a coaxial connector such that the adapter can receive a female connector in accordance with one embodiment of the present invention can include inserting the dual male pin 536 into the female contact 110 of the center conductor 108 and connecting a corresponding slider with the adapter. As shown in the flowchart of FIG. 7, a female adapter 100 either having a female slider 104 connected with the adapter 100 or no slider at all can be changed so that the adapter is a male adapter having a male slider, or vice versa. A slider 104,106 connected with the adapter 100,102 must first be removed (Step 700). In order to insert and align the dual male pin 436 in the center conductor 108 of the adapter, the pressure tool 642 is retracted by sliding the pressure tool 642 toward a proximal end of the pin holder 640 along the pin holder 640 shaft so that a slotted portion of the pressure tool 642 does not overlap a slotted portion of the pin holder 640 (Step 702). The dual male pin can then be fitted into the distal end of the pin holder 640 for insertion into the adapter (Step 704). The adapter is inserted into the aligner 644 so that the cylinder of the adapter 644 is nested within the diameter of the aligner 644, preventing transverse movement of the adapter about an axis of symmetry of the center conductor 108 and aligning the dual male pin 436 with the center conductor 108 (Step 706). The pin holder 640 and adapter 644 are positioned so that the dual male pin 436 contacts the center conductor 108 (Step 708). The pin holder 640 and adapter 644 are then urged together such that the thick diameter of the dual male pin 436 is urged into the narrower opening of the cavity, securing the dual male pin 536 to the adapter (Step 710). Once the dual male pin 436 has been fixedly connected with the adapter 100, a corresponding slider can be connected with the male adapter for fixedly connecting the male adapter with a complimentary female adapter. In some embodiment the slider is a male slider. In other embodiments, a female slider can be connected with the male adapter. The slider need not be a specific sex, as long as the adapter with which the male adapter is to mate includes a complimentary slider of an opposite sex, whether male or female.

Figure 8:
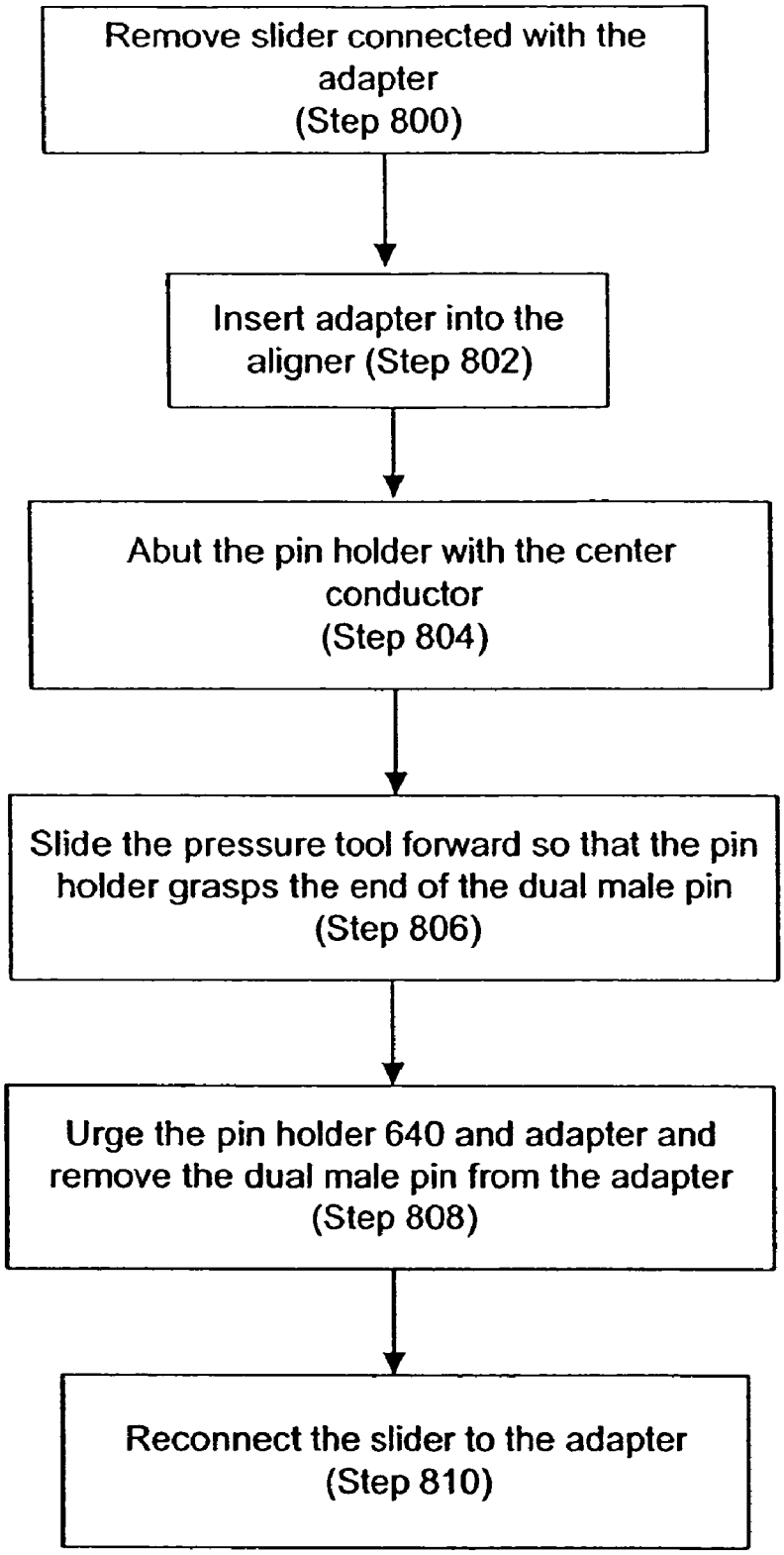
FIG. 8 is a flowchart illustrating a method to change the sex of a male adapter in accordance with one embodiment of the present invention.

A method for changing the sex of a male adapter to a female adapter can similarly include replacing the slider connected with the adapter, and aligning and positioning the insertion tool relative to the adapter. As shown in the flowchart of FIG. 8, the slider must be removed from the adapter to be replaced with a slider corresponding to the sex of the adapter and to allow the insertion tool to align with the adapter (Step 800). The aligner 644 aligns the pin holder 640 and pressure tool 642 with the adapter 100 during both insertion and withdrawal of the dual male pin 436 (Step 802). The pin can be withdrawn by abutting the pin holder with the center conductor so that a portion of the dual male pin extending from the center conductor is enveloped by the pin holder (Step 804). The pressure tool 642 is slid forward so that the slotted portion of the pressure tool 642 overlaps the slotted portion of the pin holder 640, squeezing the pin holder 640 so that the pin holder grasps the end of the dual male pin (Step 806). The pin holder 640 and adapter can be urged apart to overcome the increased diameter holding force of the dual male pin 436 and the dual male pin 436 can be removed from the adapter (Step 808). Following removal of the dual male pin 436, the slider can be reconnected to the adapter (Step 810), or a slider of an opposite sex can be connected with the adapter. As explained above, in some embodiment the slider is a male slider, while in other embodiments, a female slider can be connected with the male adapter. The slider need not be a specific sex, as long as the adapter with which the male adapter is to mate includes a complimentary slider of an opposite sex, whether male or female.

Figure 9:
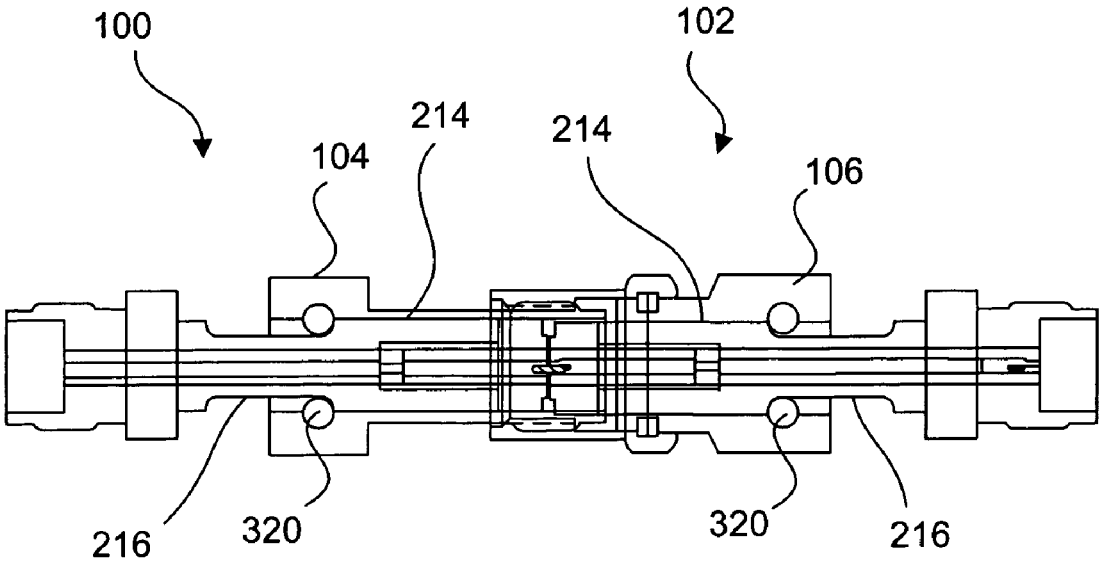
FIG. 9 is a side view of a pair of adapters having complimentary sliders connected such that the adapters are locked in position.

The male and female sliders can be locked in place during normal use, retracted during center conductor mating, and removed and exchanged during the sex change process. FIG. 9 shows a pair of adapters 100,102 having complimentary sliders 104,106 connected such that the adapters are locked in position, each slider 104,106 being further locked in position relative to the adapter by a pair of lock pins 320 slid to a locked position. The lock pins 320 are captured by the semicircular grooves of the cylinder 214, fixing the slider 104,106 in place.

Figure 10:
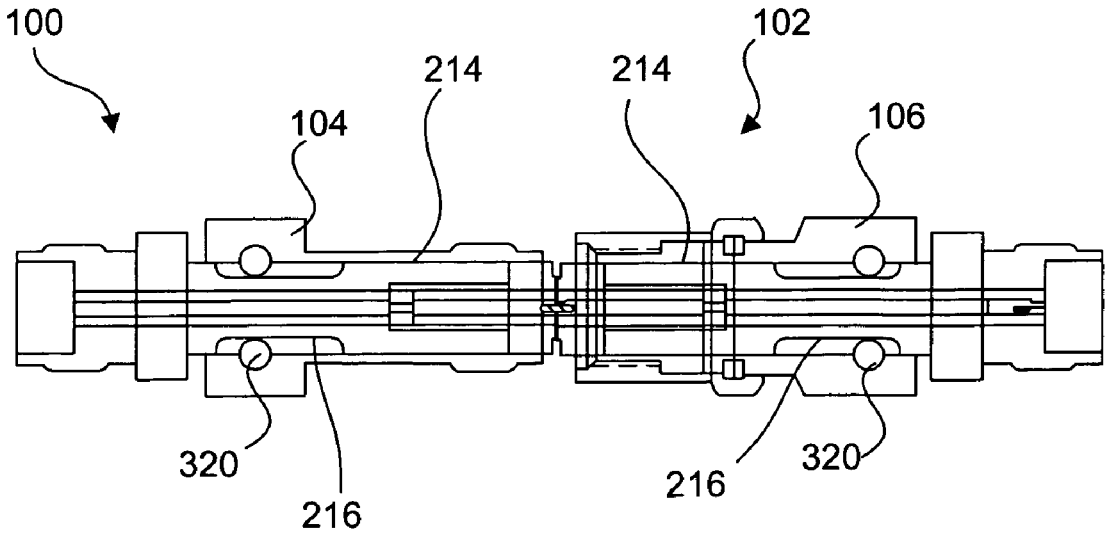
FIG. 10 is a side view of the pair of adapters of FIG. 9, wherein the sliders are in a retracted position.

FIG. 10 shows the pair of adapters 100,102 having sliders 104,106 in retracted positions, exposing the interface between the adapters. Each slider 104,106 being further locked into the two parallel flats of the adapter by the pair of lock pins 320, and are permitted to slide along length of the flats. The lock pins 320 are captured by the flats of the outer conductor, preventing the slider 104,106 from rotating or being removed from the adapter, but allowing the slider 104,106 to slide along the length of the flats 216. The retractability of the sliders 104,106 allows the connector interface to be viewed during connector mating to prevent damage to fragile center conductors. When the complementary sliders 104,106 are removably connected together, the lock pins 320 lock the sliders 104,106 at the distal end of the flats.

Figure 11A:
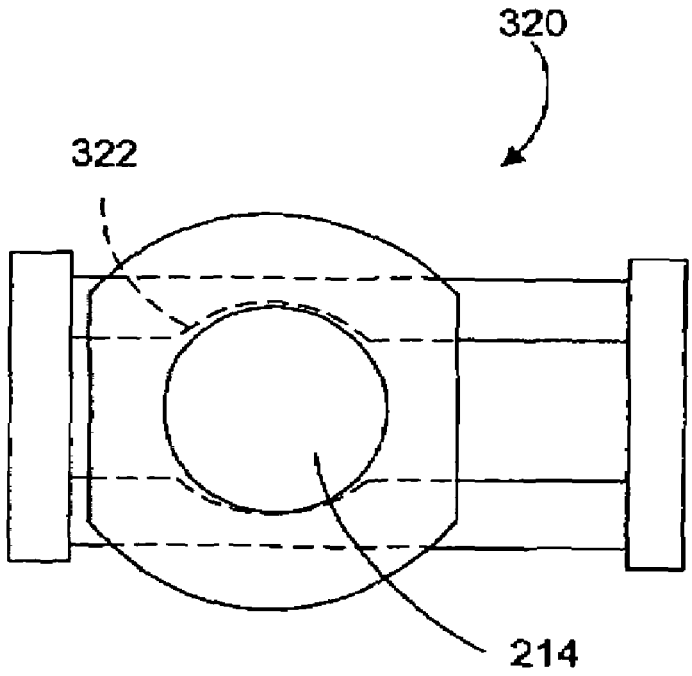
FIG. 11A is a frontal view of the lock pins in an unlocked position.
Figure 11B:
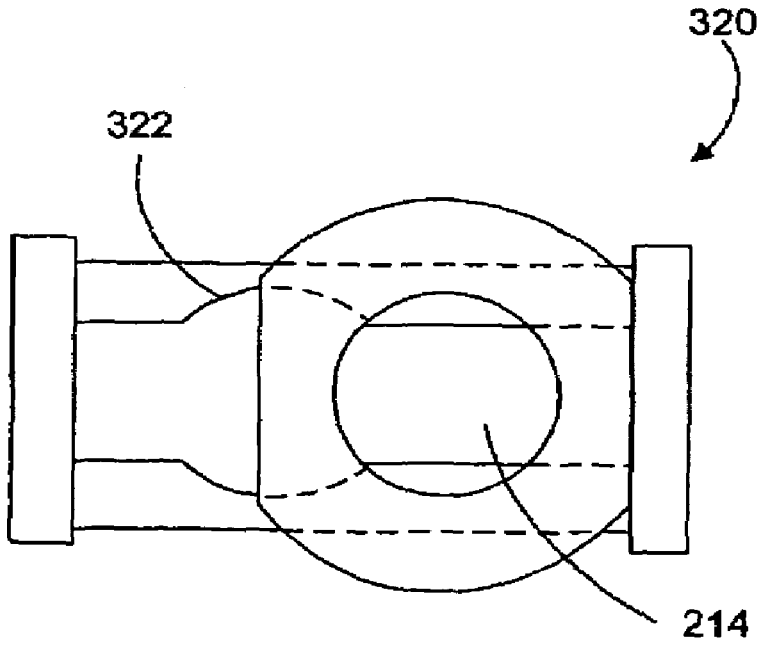
FIG. 11B is a frontal view of the lock pins of FIG. 11A in a locked position.

FIGS. 11A and 11B illustrates the operation of the lock pins 320. As shown in FIG. 11A, to unlock the slider 104,106, the lock pins 320 can be slid into position such that the semi-circular grooves 322 are aligned with the cylinder 214. The slider 104,106 can then be removed from the adapter 100,102 or rotated 90 degrees so that the lock pins 320 are oriented approximately parallel to the flats. As shown in FIG. 10B, to lock the slider 104,106, the lock pins 320 can be slid such that the semi-circular grooves 322 are no longer aligned with the cylinder 214 and the lock pins 320 engage the notches in the cylinder 214. With the lock pins 320 in the locked position, the slider 104,106 is fixedly connected with the adapter 100,102, and cannot be lost. Changing from the locked to the unlocked position is more convenient and less time consuming using lock pins 320 including semi-circular grooves 322, rather than lock pins 320 that require complete removal.

Figure 12:
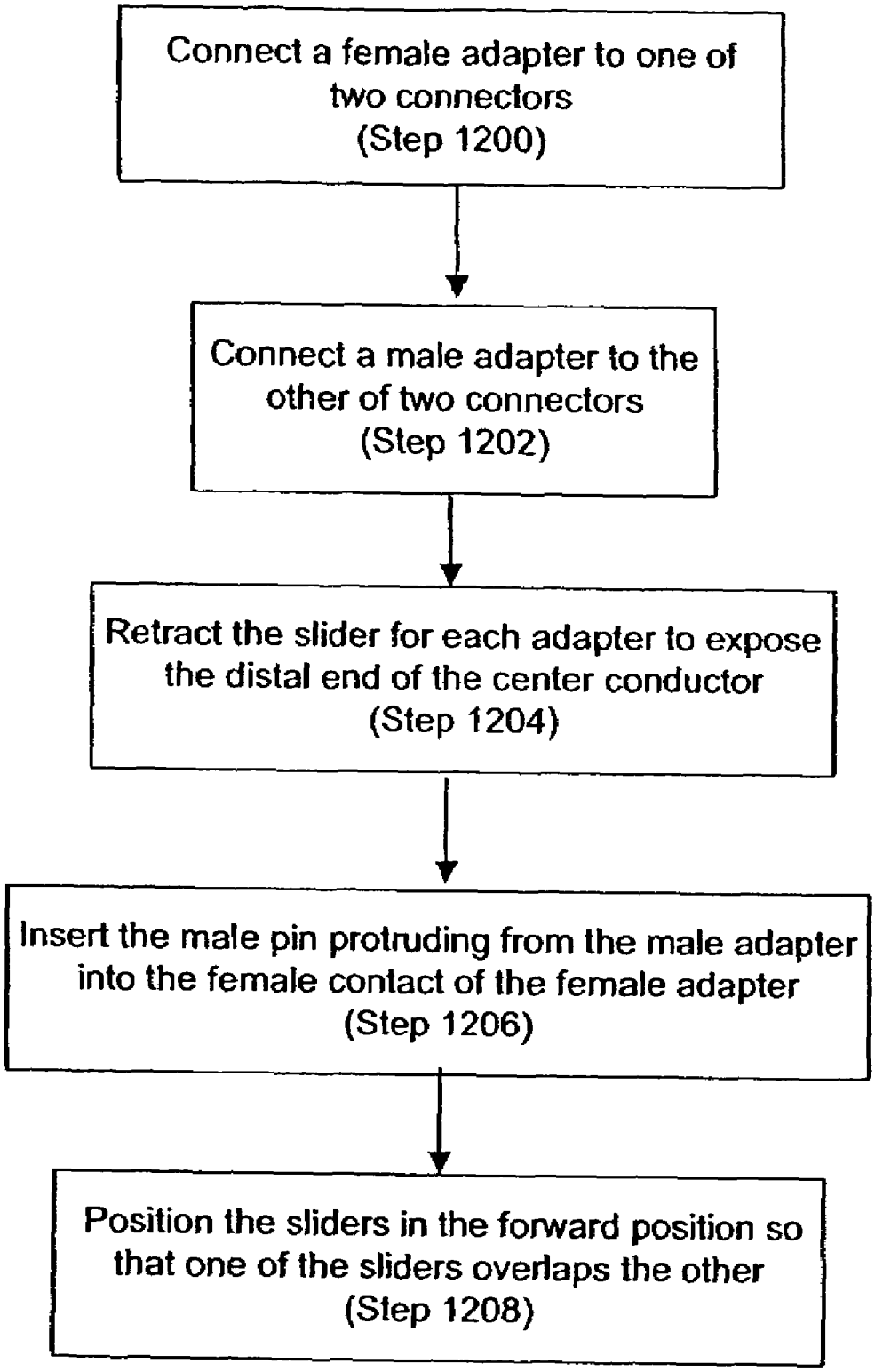
FIG. 12 is a flowchart illustrating a method to mate connectors having the same sex in accordance with one embodiment of the present invention.

FIG. 12 is a flowchart showing a method for mating two connectors having the same sex in accordance with one embodiment of the present invention. The method can include connecting an female adapter to one of the two connectors (Step 1200) and a male adapter to the other of the two connectors (Step 1202). The slider for each of the adapters can then be retracted to expose the distal end of the center conductor (Step 1204). The adapters can be mated by inserting the male pin protruding from the male adapter into the female contact of the female adapter so that the distal ends of the center conductor abut (Step 1206). The sliders can then be positioned in the forward position so that one of the sliders overlaps the other, locking the adapters in position (Step 1208).

Systems and methods in accordance with embodiments of the present invention can be used to change the sex of any coaxial connector, and the description provided should not be construed as applying only to test ports in test systems.

The foregoing description of preferred embodiments of the present invention has been provided for the purposes of illustration and description. It is not intended to be exhaustive or to limit the invention to the precise forms disclosed. Many modifications and variations will be apparent to one of ordinary skill in the relevant arts. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the claims and their equivalence.

The invention claimed is:

1. A system for changing the sex of a coaxial connector comprising:

an adapter having an interface at a distal end of the adapter;

a slider slidably associated with the adapter to selectably expose the interface;

a lock pin operably associated with the slider;

wherein when the lock pin is arranged in a first position, the lock pin is shaped to engage the adapter to define a range of motion of the slider relative to the adapter; and wherein when the lock pin is arranged in a second position, the lock pin is shaped to pass over the adapter, thereby allowing the slider to be disassociated from the adapter.

2. The system of claim 1, wherein:

the adapter includes a female connector at a proximal end.

3. The system of claim 2, further including:

a center conductor connected between the female connector and the interface; and a female contact disposed within the center conductor for receiving a dual male pin.

4. The system of claim 3, further including a dual male pin.

5. The system of claim 1, wherein the slider is adapted to slide along at least a portion of the length of the adapter such that the interface is exposed.

6. The system of claim 1, wherein:

the adapter includes a flat length extending along a portion of the adapter; and the lock pin is adapted to slide within the flat to enable motion of the slider relative to the adapter.

7. The system of claim 4, including:

a pin holder to hold the dual male pin; and an aligner to arrange the dual male pin such that a portion of the dual male pin can be positioned within the female contact.

8. A system for changing the sex of a coaxial connector comprising:

an adapter having a proximal end and a distal end, the adapter having:

a female connector at the proximal end;

an interface at the distal end;

a center conductor connected between the female connector and the interface, including a female contact for receiving a dual male pin;

one of a male slider and a female slider slidably associated with the adapter to selectably expose the interface;

a lock pin operably associated with the slider;

wherein when the lock pin is arranged in a first position, the lock pin is shaped to engage the adapter to define a range of motion of the slider relative to the adapter; and wherein when the lock pin is arranged in a second position, the lock pin is shaped to pass over the adapter, thereby allowing the slider to be exchanged with the other of a male and female slider.

9. The system of claim 8, wherein the first slider is adapted to slide along at least a portion of the length of the adapter such that the interface can be exposed.

10. The system of claim 8, further including a dual male pin.

11. The system of claim 8, wherein:

the adapter includes a flat having a length extending along a portion of the adapter; and the lock pin is adapted to slide within the flat to enable motion of the slider relative to the adapter.

12. The system of claim 10, further comprising:

an insertion tool for inserting the dual male pin into the female contact.

13. The system of claim 10, wherein the insertion tool includes:

a pin holder to hold the dual male pin; and an aligner to arrange the dual male pin such that a portion of the dual male pin can be positioned within the female contact.

* * * * *